US007935005B1

(12) United States Patent
Botsford

(10) Patent No.: US 7,935,005 B1
(45) Date of Patent: May 3, 2011

(54) GOLF ASSISTANCE DEVICE

(76) Inventor: Curtis M. Botsford, Chicago, IL (US)

( * ) Notice: Subject to any disclaimer, the term of this patent is extended or adjusted under 35 U.S.C. 154(b) by 119 days.

(21) Appl. No.: 12/383,700

(22) Filed: Mar. 27, 2009

Related U.S. Application Data

(60) Provisional application No. 61/072,192, filed on Mar. 28, 2008.

(51) Int. Cl.
*A63B 57/00* (2006.01)

(52) U.S. Cl. ..... 473/408

(58) Field of Classification Search ..... 473/408, 473/406, 286; D21/793, 794
See application file for complete search history.

(56) References Cited

U.S. PATENT DOCUMENTS

| | | | | | |
|---|---|---|---|---|---|
| 3,456,737 | A * | 7/1969 | Rhyme | 473/408 |
| 3,539,017 | A * | 11/1970 | Johnson | 473/408 |
| D238,436 | S * | 1/1976 | McKelvey | D21/793 |
| D285,233 | S * | 8/1986 | Owen | D21/793 |
| D306,057 | S * | 2/1990 | Vaughan, Jr. | D21/793 |
| 5,388,824 | A * | 2/1995 | Reimers | 473/406 |
| 5,449,169 | A * | 9/1995 | Hardin et al. | 473/408 |
| 5,562,553 | A * | 10/1996 | Digerness et al. | 473/408 |
| 5,769,740 | A | 6/1998 | Colangelo | |
| 6,004,229 | A | 12/1999 | Fazekas | |
| D425,163 | S * | 5/2000 | Cauffman et al. | D21/793 |
| 6,413,173 | B1 * | 7/2002 | Muller et al. | 473/408 |
| 6,413,174 | B1 * | 7/2002 | Roberts | 473/408 |
| 6,428,430 | B1 * | 8/2002 | Chong | 473/408 |
| 6,620,062 | B2 * | 9/2003 | Taylor et al. | 473/408 |
| D500,828 | S * | 1/2005 | Pace | D21/793 |
| 6,837,807 | B1 * | 1/2005 | Kerr | 473/408 |
| 7,004,858 | B2 | 2/2006 | Bauley et al. | |
| 7,238,125 | B2 * | 7/2007 | Dymling | 473/408 |
| 7,686,710 | B2 * | 3/2010 | Leiber et al. | 473/408 |
| 2010/0022330 | A1 * | 1/2010 | Rourke et al. | 473/406 |

* cited by examiner

*Primary Examiner* — Steven Wong
(74) *Attorney, Agent, or Firm* — Emery L. Tracy

(57) ABSTRACT

A golf assistance device for aiding golfers while playing golf is provided. The golf assistance device comprises a housing having a top surface, a bottom surface, a first side, a second side, a first end, and a second end with the top surface and the bottom surface creating a space and the second end being open. An elongated slot is formed in the top surface of the housing. A divot repair tool is receivable within the space. A protrusion is formed on the top surface of the divot repair tool with the protrusion receivable within and slidable along the elongated slot formed in the housing. A tensioning mechanism tensions the divot repair tool in either a retracted position or an extended position. A money clip is secured to the first end of the housing. A golf ball placement marker system is secured to the money clip. A marking coin is releasably securable to the golf ball placement marker system.

18 Claims, 5 Drawing Sheets

GOLF ASSISTANCE DEVICE

The present application claims the benefit of priority of provisional patent application Ser. No. 61/072,192, filed on Mar. 28, 2008, entitled "Golf Ball Marker and Money Clip".

BACKGROUND OF THE INVENTION

1. Field of the Invention

This invention relates generally to a golf assistance device and, more particularly, the invention relates to a golf assistance device for combining a divot repair tool, a golf ball placement marker, and a money clip into one convenient unit.

2. Description of the Prior Art

Golf, a game of Scottish origin, is one of the most popular recreational and competitive sports in the world. Each participant uses a variety of clubs to drive a small ball into a succession of either nine or eighteen designated holes, over a course designed to present obstacles, in as few strokes as possible. Today, in the United States alone, more than 23 million people play golf, including over 11,000 professional players. A relaxing game of strategy and skill, this outdoor sport has become a favored pastime of men, women, and even children.

In addition to golf balls and the clubs that are used to strike them, many essential components are necessary for an optimal golf game. One such ubiquitous implement is a ball marker. Serving to inscribe an identifying mark on a ball so that a golfer can easily recognize and retrieve it, this tool is usually in the form of a circular disc of which the edge is employed to carve a line or initials into the ball. Sometimes, golfers simply use a handy coin for this purpose. Yet, keeping a marker readily accessible in the course of a game can be quite challenging. Having to dig through pockets or golf bags to locate a marker every time one is needed tends to be frustrating, taking away precious time from the golfer's favorite sport. Embarrassed, the golfer has no choice but to borrow a marker or coin from a fellow golfer or worse, scavenge the ground for a twig or similar in order to inscribe his ball.

SUMMARY

The present invention is a golf assistance device for aiding golfers while playing golf. The golf assistance device comprises a housing having a top surface, a bottom surface, a first side, a second side, a first end, and a second end with the top surface and the bottom surface creating a space and the second end being open. An elongated slot is formed in the top surface of the housing. A divot repair tool is receivable within the space. A protrusion is formed on the top surface of the divot repair tool with the protrusion receivable within and slidable along the elongated slot formed in the housing. A tensioning mechanism tensions the divot repair tool in either a retracted position or an extended position. A money clip is secured to the first end of the housing. A golf ball placement marker system is secured to the money clip. A marking coin is releasably securable to the golf ball placement marker system.

The present invention further includes a method for aiding golfers while playing golf. The method comprises providing a housing having a top surface, a bottom surface, a first side, a second side, a first end, and a second end, creating a space between the top surface and the bottom, forming an opening in the second end, forming an elongated slot in the top surface of the housing, positioning a divot repair tool within the space, forming a protrusion on the top surface of the divot repair tool, inserting the protrusion within the elongated slot, sliding the protrusion along the elongated slot formed in the housing, tensioning the divot repair tool in either a retracted position or an extended position, securing a money clip to the first end of the housing, securing a golf ball placement marker system to the money clip, and releasably securing a marking coin to the golf ball placement marker system.

DETAILED DESCRIPTION OF THE PREFERRED EMBODIMENTS

Figure 1:
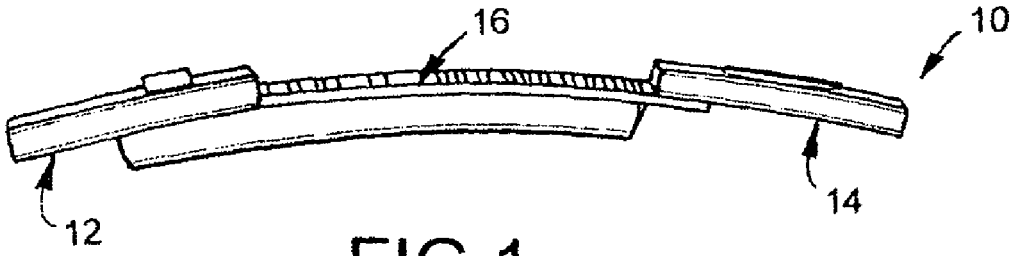
FIG. 1 is a side view perspective view illustrating a golf assistance device, constructed in accordance with the present invention, with the divot repair tool in a retracted position.
Figure 2:
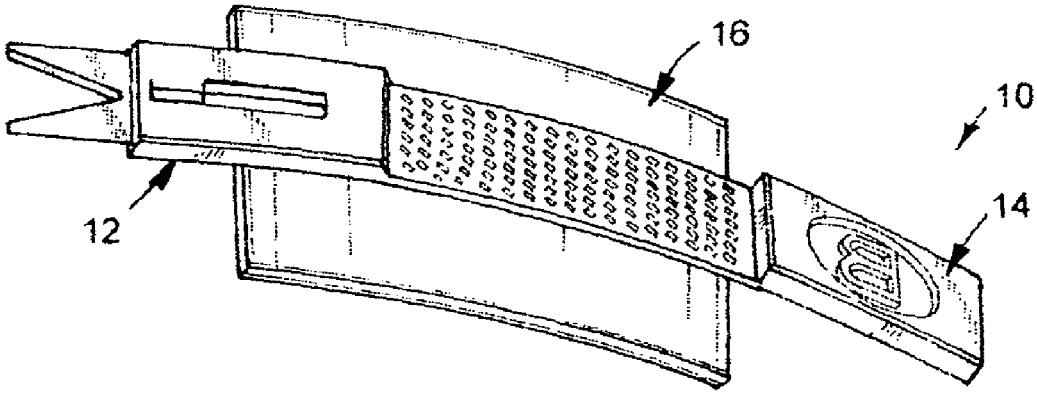
FIG. 2 is a perspective view illustrating the golf assistance device, constructed in accordance with the present invention, with the divot repair tool in an extended position.
Figure 3:
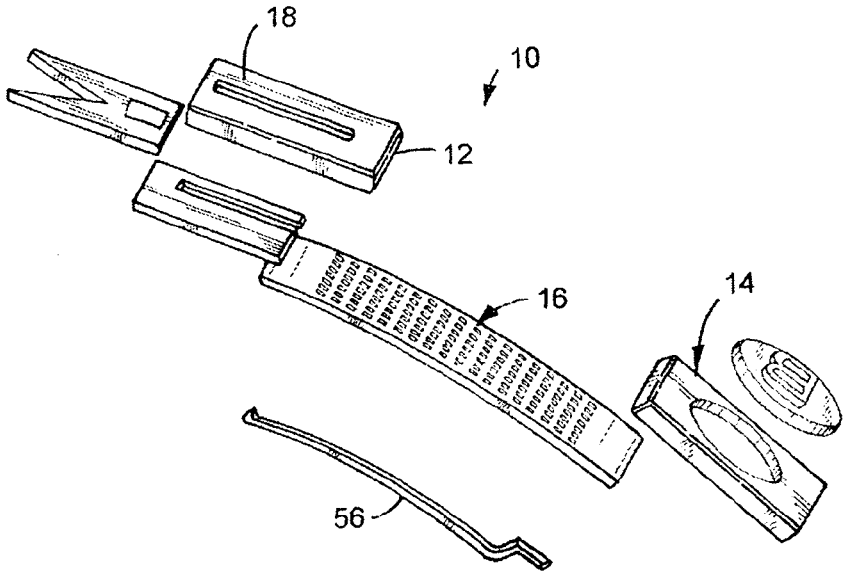
FIG. 3 is an exploded perspective view illustrating the golf assistance device, constructed in accordance with the present invention.

As illustrated in FIGS. 1-3, the present invention is a golf assistance device, indicated generally at 10, for aiding golfers while playing golf. The golf assistance device 10 of the present invention combines a divot repair tool system 12, a golf ball placement marker system 14, and a money clip 16 into one convenient unit.

Figure 4:
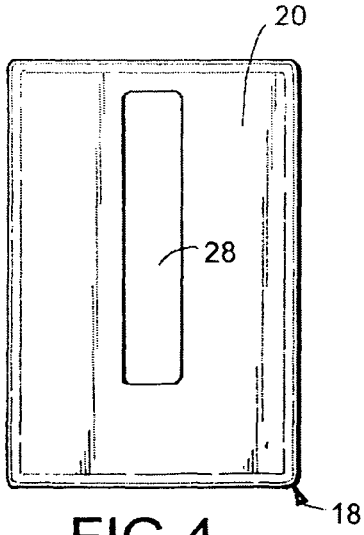
FIG. 4 is a top view illustrating a divot repair tool top cover of the golf assistance device, constructed in accordance with the present invention.
Figure 5:
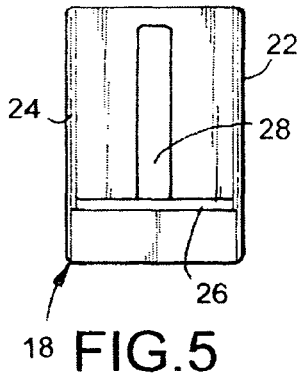
FIG. 5 is a bottom view illustrating the divot repair tool top cover of the golf assistance device, constructed in accordance with the present invention.
Figure 6:
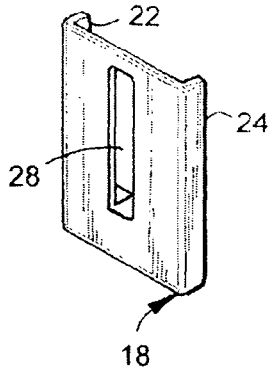
FIG. 6 is a perspective view illustrating the divot repair tool top cover of the golf assistance device, constructed in accordance with the present invention.

As stated, the golf assistance device 10 of the present invention includes the divot repair tool system 12. As illustrated in FIGS. 4-6, the divot repair tool system 12 includes a top cover 18 having a top wall 20, a first side wall 22, a second side wall 24 substantially parallel to the first side wall 22, and a third side wall 26 between and substantially perpendicular to the first side wall 22 and the second side wall 26. An elongated slot 28 is formed in the top wall 20 of the divot repair tool system 12.

Figure 7:
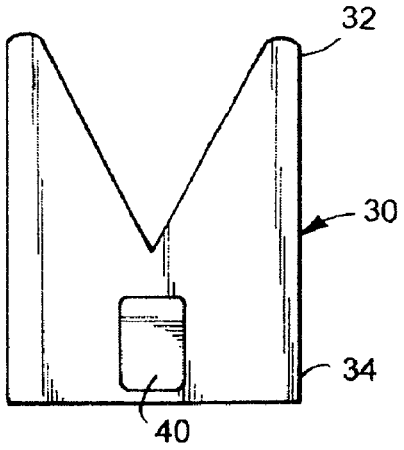
FIG. 7 is a top view illustrating the divot repair tool of the golf assistance device, constructed in accordance with the present invention.
Figure 7A:
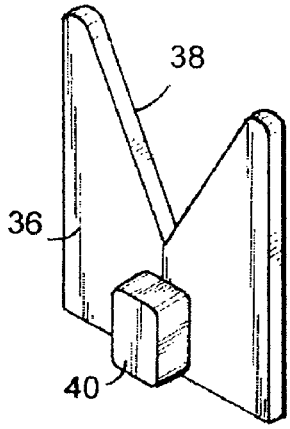
FIG. 7*a* is a perspective view illustrating the divot repair tool of the golf assistance device, constructed in accordance with the present invention.

As illustrated in FIGS. 7 and 7*a*, the divot repair tool system 12 of the golf assistance device 10 additionally includes a divot repair tool 30 having a first end 32, a second end 34 opposite the first end 32, a top surface 36, and a bottom surface 38 opposite the top surface 36. The first end 32 of the divot repair tool 30 is a forked end for use in repairing divots and ball marks in a known fashion. The top surface 36 of the divot repair tool 30 has a protrusion 40 extending upward therefrom. The protrusion 40 is sized and shaped to be received within and slidable along the elongated slot 28 formed in the top cover 18. Operation of the divot repair tool 30 will be discussed in further detail below.

Figure 9:
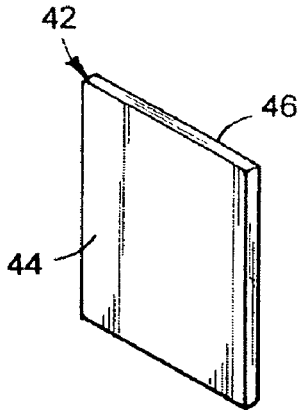
FIG. 9 is a perspective view illustrating the divot repair tool bottom cover of the golf assistance device, constructed in accordance with the present invention.
Figure 8:
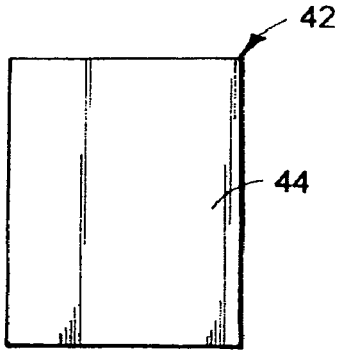
FIG. 8 is a top view illustrating a divot repair tool bottom cover of the golf assistance device, constructed in accordance with the present invention.

As illustrated in FIGS. 8 and 9, the divot repair tool system 12 of the golf assistance device 10 of the present invention further includes a bottom cover 42 having a top surface 44 and a bottom surface 46. The bottom surface 46 of the bottom cover 42 is secured to the first side wall 22, the second side wall 24, and the third side wall 26 of the top cover 18 creating a space for the divot repair tool 30 to slide between the top cover 18 and the bottom cover 46. The bottom cover 46 can be secured to the top cover 18 by any means including, but not limited to, welding, adhesive, etc.

Figure 11:
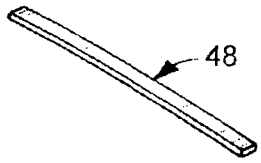
FIG. 11 is a perspective view illustrating the tension spring for the divot repair tool of the golf assistance device, constructed in accordance with the present invention.
Figure 10:
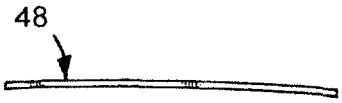
FIG. 10 is an elevational side view illustrating a tension spring for the divot repair tool of the golf assistance device, constructed in accordance with the present invention.

As illustrated in FIGS. 10 and 11, the divot repair tool system 12 includes a tension spring 48 for tensioning the divot repair tool 30 in either a retracted position (completely within the space between the top cover 18 and the bottom cover 42) or an extended position (with the forked end 32 of the divot repair tool 30 extending from between the top cover 18 and the bottom cover 42). The tension spring 48 is secured or otherwise positioned on the bottom surface 46 of the bottom cover 42 contacting the bottom surface 38 of the divot repair tool 30. The tension spring 42 is preferably slightly curved upward from the bottom surface 46 of the bottom cover 42 such that the divot repair tool 30 is initially biased in the retracted position. By sliding the protrusion 40 through the elongated slot 26, the forked end 32 of the divot repair tool 30 overcomes the bias and emerges from the space between the top cover 18 and the bottom cover 42. The divot repair tool 30 is then biased in the extended position allowing the golfer to use the forked end 32 to repair divots and/or ball marks without the forked end 32 easily retracting into the space. Manipulation of the protrusion 40 along the elongated slot 26 in the other direction retracts the forked end 32 back into the space and into the retracted position.

Figure 13:
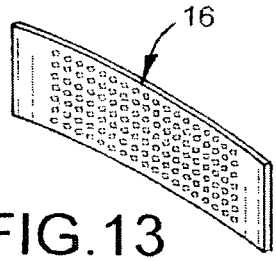
FIG. 13 is a perspective view illustrating the connecting band of the golf ball marker and money clip system, constructed in accordance with the present invention.
Figure 12:
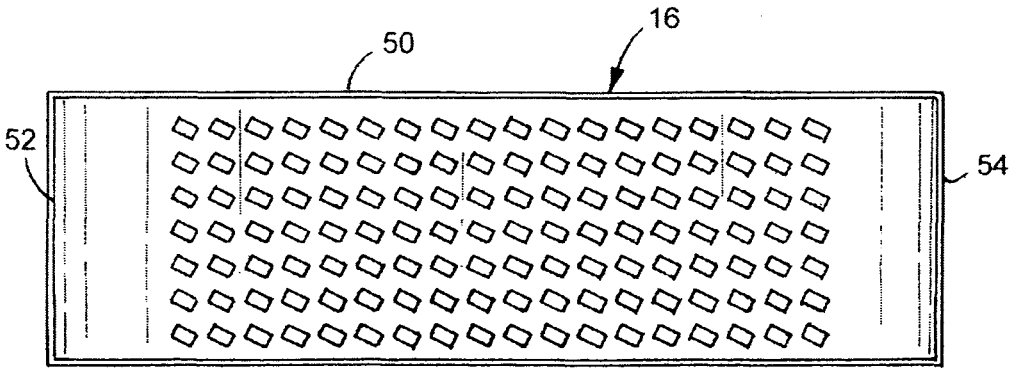
FIG. 12 is a top plan view illustrating a connecting band of the golf assistance device, constructed in accordance with the present invention.
Figure 15:
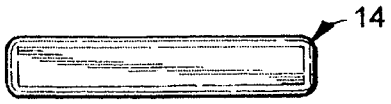
FIG. 15 is an end view illustrating the placement marker holder of the golf assistance device, constructed in accordance with the present invention.
Figure 14:
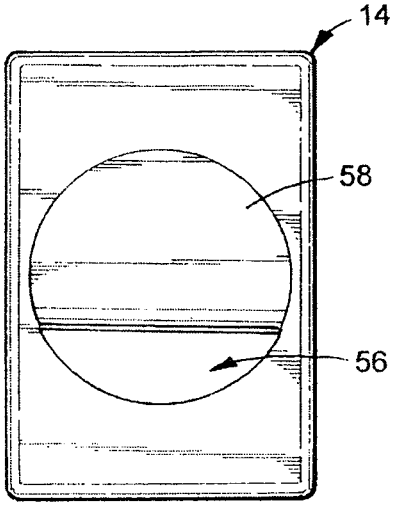
FIG. 14 is a top plan view illustrating a placement marker holder of the golf assistance device, constructed in accordance with the present invention.
Figure 16:
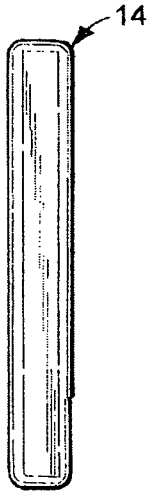
FIG. 16 is a side view illustrating the placement marker holder of the golf assistance device, constructed in accordance with the present invention.
Figure 17:
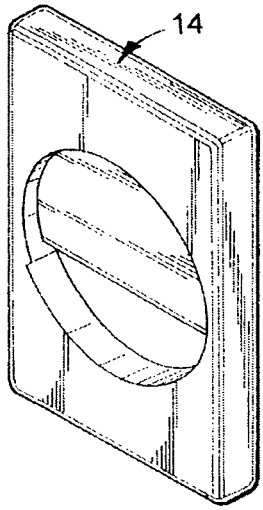
FIG. 17 is a perspective view illustrating the placement marker holder of the golf assistance device, constructed in accordance with the present invention.
Figure 20:
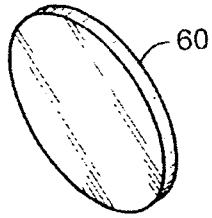
FIG. 20 is a perspective view illustrating the golf ball placement marker of the golf assistance device, constructed in accordance with the present invention.
Figure 18:
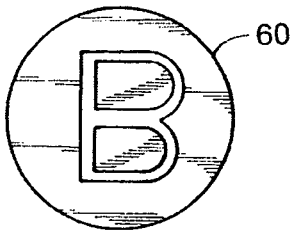
FIG. 18 is a top plan view illustrating a golf ball placement marker of the golf assistance device, constructed in accordance with the present invention.
Figure 19:
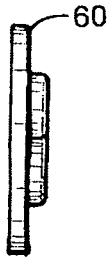
FIG. 19 is a side view illustrating the golf ball placement marker of the golf assistance device, constructed in accordance with the present invention.

As illustrated in FIGS. 12 and 13, the golf assistance device of the present invention includes the money clip 16. The money clip 16 includes a band 50 having a first end 52 and a second end 54. The first end 52 of the band 50 is secured to the divot repair tool system 12. Preferably, the band 50 is constructed from a semi-flexible material although constructing the band 50 from other materials is within the scope of the present invention. A clip 56 (as illustrated in FIG. 3) secured to the band 50 releasably holds money bills and/or credit cards.

As illustrated in FIGS. 14-20, the golf assistance device of the present invention includes the golf ball placement marker system 14 secured to the second end 54 of the band 50. The golf ball placement marker system 14 includes an aperture 56 in the proximate center of the golf ball placement marker system 14. Within the aperture 56, a plate 58 extends slightly greater than half way across the aperture 56 thereby blocking a portion of the aperture 56. A marking coin 60 or the like is insertable within the aperture 56 against the plate 58. The plate 58 can be magnetic or a magnet or the like can be used to hold the marking coin 60 releasably within the aperture 56.

Preferably fashioned from an attractive gold or silver material, the golf assistance device 10 of the present invention is basically rectangular in shape, measuring approximately four (4") inches to five (5") inches in length, approximately one (1") inch to one and one-quarter (1¼") inches in width, and approximately one-quarter (¼") inch to one-half (½") inch in depth. Resembling a standard money clip, yet enhanced with stronger components, the metallic material that comprises the golf assistance device 10 serves as the tension for keeping valuables clipped, and can be configured to hold any number of credit and ID cards and any number of bills. In a preferred embodiment, the golf assistance device 10 holds up to ten (10) credit and ID cards as well as twenty-five $20 bills (or $500 in cash). The golf assistance device 10 culminates in a gold or silver golf ball placement marker system 14 as the actual holder for a marking coin 60. In addition, the surface of the golf ball placement marker system 14 and marking coin 60 can be customized with engravings featuring the golfer's initials, or even as a tribute to their best golf score.

When used, the golfer need only affix the golf assistance device 10 to the person, via the provided clip, and immediately begin play. When needing to mark the ball, the user reaches down and removes the marking coin 60 from the golf ball placement marker system's 14 magnetic plate 58, replacing it when finished. In this manner, the marking coin 60 is always at the ready, eliminating any time consuming searches for a marker or a makeshift instrument for that purpose. In addition, the combination of the marking coin 60 into a durable money clip provides a secure means of managing cash and cards that will not break as easily as common money clips.

The golf assistance device 10 of the present invention extends beyond its practical purposes. A gold or silver, attractive apparatus, the golf assistance device 10 provides a stylish accessory for any golfer. Sure to capture the attention of fellow golfers, the eye-catching golf assistance device 10 will certainly impress all who see it, and they will want one of their very own. Young golfers, especially, will benefit from the golf assistance device 10, as it provides an easy and expedient means of marking their balls in addition to offering a fun and novel trinket for them to sport. With its durable construction and incorporation of gold or silver to give the golf assistance device 10 an appealing sense of "bling", the golf assistance device 10 and money clip makes the perfect gift for a golfer, one that can be enjoyed for many years to come.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A golf assistance device for aiding golfers while playing golf, the golf assistance device comprising:

a housing having a top surface, a bottom surface, a first side, a second side, a first end, and a second end, the top surface and the bottom surface creating a space, the second end being open;

an elongated slot formed in the top surface of the housing;

a divot repair tool receivable within the space;

a protrusion formed on the top surface of the divot repair tool, the protrusion receivable within and slidable along the elongated slot formed in the housing;

tensioning means for tensioning the divot repair tool in either a retracted position or an extended position;

a money clip secured to the first end of the housing;

a golf ball placement marker system secured to the money clip; and a marking coin releasably securable to the golf ball placement marker system;

wherein the money clip includes a band having a first end and a second end, the first end of the band being secured to the housing and the second end of the band being secured to the golf ball placement marker system.

2. The golf assistance device of claim 1 wherein the housing comprises:

a top cover having a top wall, a first side wall, a second side wall substantially parallel to the first side wall, and a third side wall between and substantially perpendicular to the first side wall and the second side wall; and a bottom cover having a top surface and a bottom surface, the bottom surface of the bottom cover securable to the first side wall, the second side wall, and the third side wall of the top cover.

3. The golf assistance device of claim 1 wherein the divot repair tool has a forked end.

4. The golf assistance device of claim 1 wherein the tensioning means is a tension spring is secured within the housing against the divot repair tool.

5. The golf assistance device of claim 4 wherein the tension spring is slightly curved upward such that the divot repair tool is biased in the either retracted position or the extended position.

6. The golf assistance device of claim 1 wherein the band is constructed from a semi-flexible material.

7. The golf assistance device of claim 1 and further comprising:

a clip secured to the band.

8. The golf assistance device of claim 1 wherein the golf ball placement marker system includes an aperture and a plate extending through the aperture thereby blocking a portion of the aperture.

9. The golf assistance device of claim 8 wherein the marking coin is insertable within the aperture against the plate, the plate being magnetic.

10. A method for aiding golfers while playing golf, the method comprising:

providing a housing having a top surface, a bottom surface, a first side, a second side, a first end, and a second end;

creating a space between the top surface and the bottom;

forming an opening in the second end;

forming an elongated slot in the top surface of the housing;

positioning a divot repair tool within the space;

forming a protrusion on the top surface of the divot repair tool;

inserting the protrusion within the elongated slot;

sliding the protrusion along the elongated slot formed in the housing;

tensioning the divot repair tool in either a retracted position or an extended position;

securing a money clip to the first end of the housing;

securing a golf ball placement marker system to the money clip;

releasably securing a marking coin to the golf ball placement marker system;

a band having a first end and a second end;

securing the first end of the band to the divot repair tool; and securing the second end of the band to the golf ball placement marker system.

11. The method of claim 10 and further comprising:

forking one end of the divot repair tool.

12. The method of claim 10 and further comprising:

securing a clip to the band.

13. The method of claim 10 and further comprising:

forming an aperture in the golf ball placement marker system; and extending a magnetic plate through a portion of the aperture.

14. The method of claim 13 and further comprising:

inserting the marking coin within the aperture and against the plate.

15. A golf assistance device for aiding golfers while playing golf, the golf assistance device comprising:

a housing having a top surface, a bottom surface, a first side, a second side, a first end, and a second end, the top surface and the bottom surface creating a space, the second end being open;

an elongated slot formed in the top surface of the housing;

a divot repair tool receivable within the space, at least one end of the divot repair tool being forked;

a protrusion formed on the top surface of the divot repair tool, the protrusion receivable within and slidable along the elongated slot formed in the housing;

tensioning means for tensioning the divot repair tool in either a retracted position or an extended position;

a band secured to the first end of the housing;

a clip secured to the band;

a golf ball placement marker system secured to the band; and a marking coin releasably securable to the golf ball placement marker system.

16. The golf assistance device of claim 15 wherein the tensioning means is a tension spring is secured within the housing against the divot repair tool.

17. The golf assistance device of claim 16 wherein the tension spring is slightly curved upward such that the divot repair tool is biased in the either retracted position or the extended position.

18. The golf assistance device of claim 15 wherein the golf ball placement marker system includes an aperture and a magnetic plate extending through the aperture thereby blocking a portion of the aperture.

* * * * *